US008931916B2

(12) United States Patent
Nalitchaev et al.

(10) Patent No.: US 8,931,916 B2
(45) Date of Patent: Jan. 13, 2015

(54) LIGHTING INSTALLATION AND METHOD FOR USING THE SAME

(76) Inventors: Boris Vladimirovitch Nalitchaev, Moscow (RU); Ilia Borisovitch Nalitchaev, Moscow (RU)

( * ) Notice: Subject to any disclaimer, the term of this patent is extended or adjusted under 35 U.S.C. 154(b) by 159 days.

(21) Appl. No.: 13/806,273

(22) PCT Filed: Jul. 21, 2011

(86) PCT No.: PCT/RU2011/000543

§ 371 (c)(1),
(2), (4) Date: Dec. 21, 2012

(87) PCT Pub. No.: WO2012/011849

PCT Pub. Date: Jan. 26, 2012

(65) Prior Publication Data

US 2013/0229792 A1 Sep. 5, 2013

(30) Foreign Application Priority Data

Jul. 22, 2010 (EA) ..... 201001107

(51) Int. Cl.

| | |
|---|---|
| ***F21L 13/00*** | (2006.01) |
| ***F21V 3/02*** | (2006.01) |
| ***F21V 17/00*** | (2006.01) |
| ***F21V 21/06*** | (2006.01) |
| *F21W 131/10* | (2006.01) |

(52) U.S. Cl.

CPC ..... *F21L 13/00* (2013.01); *F21V 3/023* (2013.01); *F21V 17/007* (2013.01); *F21V 21/06* (2013.01); *F21W 2131/1005* (2013.01)

USPC ..... 362/192

(58) Field of Classification Search

CPC ..... F21L 13/00
USPC ..... 362/192
See application file for complete search history.

(56) References Cited

U.S. PATENT DOCUMENTS

| | | | | |
|---|---|---|---|---|
| 6,892,772 | B1 * | 5/2005 | Wang et al. | 141/313 |
| 7,320,529 | B2 * | 1/2008 | Goh et al. | 362/96 |
| 7,621,650 | B2 * | 11/2009 | Nalitchaev et al. | 362/96 |
| 7,699,495 | B2 * | 4/2010 | Au | 362/208 |
| 8,082,937 | B2 * | 12/2011 | Tarter et al. | 135/91 |
| 8,328,377 | B1 * | 12/2012 | Kothari | 362/96 |
| 2008/0106888 | A1 * | 5/2008 | Nalitchaev et al. | 362/96 |
| 2010/0246187 | A1 * | 9/2010 | Yoshimori et al. | 362/294 |
| 2012/0287615 | A1 * | 11/2012 | Kothari | 362/192 |

* cited by examiner

*Primary Examiner* — Anabel Ton
(74) *Attorney, Agent, or Firm* — Aleksandr Smushkovich

(57) ABSTRACT

The engineering solution relates to means for lighting a territory, mainly under emergency conditions. The solution allows for improving —reliability and stability of a lighting installation, and —convenience of carrying thereof and providing protection thereof during transportation. The lighting installation includes a base with supports, an inflatable shell secured to the base, and at least one electric lamp positioned inside the shell. The inner cavity of the shell is in communication with an air blower installed in the base. Each support has at least one hinge enabling turning the support and means for fixing the support. The solution contemplates a method for using the lighting installation, including mounting the installation on a power unit, before transforming thereof from a transportation position into an operative position. The place of power unit is adjusted to evenly distribute the installation's weight, the shell is inflated, the installation is secured to the power unit.

10 Claims, 6 Drawing Sheets

LIGHTING INSTALLATION AND METHOD FOR USING THE SAME

CROSS-REFERENCE TO RELATED APPLICATIONS

This application is a U.S. national stage application of a PCT application PCT/RU2011/000543 filed on 21 Jul. 2011, whose disclosure is incorporated herein in its entirety by reference, which PCT application claims priority of a EAPO patent application EA 201001107 filed on 22 Jul. 2010.

FIELD OF THE INVENTION

The present invention relates to means for illumination of a territory, mainly under emergency conditions. It is intended for use when electric power is off due to emergency or disaster as well as during construction works, repair, or search-and-rescue works in the nighttime.

BACKGROUND OF THE INVENTION

There are patent publications teaching inflatable lighting installations (U.S. Pat. No. 6,322,230B1, publ. 27.11.2001; RU 2192581C1, publ. 26.02.2001; RU 2286510C9, publ. 10.04.2006; WO 02/063207, publ. 15.08.2002), each of which has an elastic inflatable shell serving as a support for a light source secured inside the shell within an upper part of the shell, the support having a base by which the support is linked to the ground or any structural load-bearing member (a floor, a building, a frame). The inflatable supports of these lighting installations have means for maintaining their stable vertical position and these stabilizing means are tension members in RU 2192581C1 and U.S. Pat. No. 6,322,230B1; the tension members are linked to the support and to the ground, and this substantially increases complexity of the installation design.

An engineering solution being close to the instant invention is a lighting installation comprising a base, an inflatable shell secured to the base, and an electric lamp positioned inside the shell, wherein the inner cavity of the inflatable shell is in communication with an air blower secured to the base (RU 2286510C9).

Stability of this installation depends on design features of the base having a rest which negatively influences the size of the installation and its stability during operation.

The above drawback is substantial when the installation has to be urgently delivered to emergency locations and a comparatively big size of the base negatively influences the deployment time of the installation and hampers its moving during operation. While being urgently delivered, the installation is not protected against a mechanical effect which often leads to damaging easy deformable parts of the installation, particularly to rupture of the inflatable shell and especially to damaging the electric lamp positioned under a jacket within the shell, as the jacket technically does not protect the lamp against impacts. All these factors reduce the reliability of operation of the installation.

BRIEF DESCRIPTION OF THE INVENTION

The primary purpose of the invention is to improve the reliability and stability of the lighting installation, increasing the convenience of handling thereof and providing protection thereof during transportation. Other purposes can be found by a skilled artisan upon learning the present disclosure.

The aforementioned purpose (herein also called an 'advantageous effect') is attained by providing an inventive lighting installation comprising: a base with supports; an inflatable shell secured to the base, wherein the shell includes an inner cavity; and at least one electric lamp positioned inside the shell. The inner cavity of the shell is in communication with an air blower secured to the base. Each aforesaid support has at least one joint (hinge) providing for turning the support, and means for fixing the support in its lower operative position, and in its upper transportation position, wherein, when being in the upper transportation position, the supports are positioned in such a way that they are capable of serving as a handle for carrying the installation.

The base is connected to each aforesaid support via a bracket rigidly secured to the base, which bracket is hingedly connected to the end portions of the supports, thereby forming a hinge connection. The hinge connection between each aforesaid support and the bracket is preferably provided by means of a cylinder member positioned within a slot of the support, and the ends of the cylinder member are arranged in openings of the bracket.

In one embodiment of the lighting installation, each support of the installation is configured as a rod, wherein a part of the rod is bent in a longitudinal plane and in a transversal plane or in a longitudinal plane only. When the lighting installation is in the upper transportation position, the bent parts of the rods of the supports are met above the base forming a handle bound by a jacket to facilitate carrying the lighting installation. In the lower operative positions, the bent parts of the rods are positioned below the base of the lighting installation.

In another embodiment of the lighting installation, each aforesaid support of the installation is configured as a rod, wherein the free ends of the rod are bent outwardly from the base, when the lighting installation is in the operative position, and a jacket binding the free ends of each aforesaid support is provided therebetween.

In another embodiment of the lighting installation, each aforesaid support of the installation is bent in at least one plane and has a guard wall with cutouts therein, and when the lighting installation is set in a folded transportation position, the supports are met above the base and the folded inflatable shell is positioned between the guard walls of the supports, wherein the cutouts form a handle for carrying the lighting installation.

In one embodiment of the lighting installation, the means for fixing the supports are configured as bars located inside the cavities of the end portions of the supports, wherein the bars having outside protrusions, and recesses engaging the protrusions, and the recesses are arranged at the ends of each aforesaid bracket. The bars are connected to the hinges by springs located inside the cavity of the end portion of each aforesaid support.

In yet another embodiment of the lighting installation, the means for fixing the supports are configured as spring-loaded members located in openings provided in the end portions of each aforesaid support and at the ends of each aforesaid bracket.

Besides, the means for fixing the supports may be configured as bosses provided on the cheeks of each ear of the bracket, wherein the distance between the bosses should be less than the thickness of the end portions of the supports, whereas the end portions are located in the ears of the brackets, in order to make it possible to pass the support under pressure between the bosses, and the ears are configured to allow their cheeks to be parted aside when the support interacts with the bosses.

Each bracket of the lighting installation can be further equipped with means for connecting the lighting installation to an electric power supply unit (herein further called 'power unit'), which is electrically connected to the lighting installation during its operation; the means located on the lower side of the bracket.

The means for connecting the lighting installation to the power unit may be configured as sockets engaging frame members of the power unit.

The advantageous effect is also attained by providing an inventive method for using the lighting installation; the method is characterized in that the lighting installation is installed and secured on a power supply unit (herein also simply called 'power unit'); then, before deployment thereof, the lighting installation is transformed from the transportation position into the operative position. The power unit is mounted on the ground between the supports of the lighting installation, and then the slope angle of the supports and the projection length thereof are adjusted in such a way that the weight load of the lighting installation is evenly distributed over the supports and the power unit. Thereafter the lighting installation is electrically connected to the power unit, the inflatable shell is inflated with air by means of the air blower, and the lighting installation, which is secured to the power unit, then can be employed.

DETAIL DESCRIPTION OF PREFERRED EMBODIMENTS OF THE INVENTION

Figure 1:
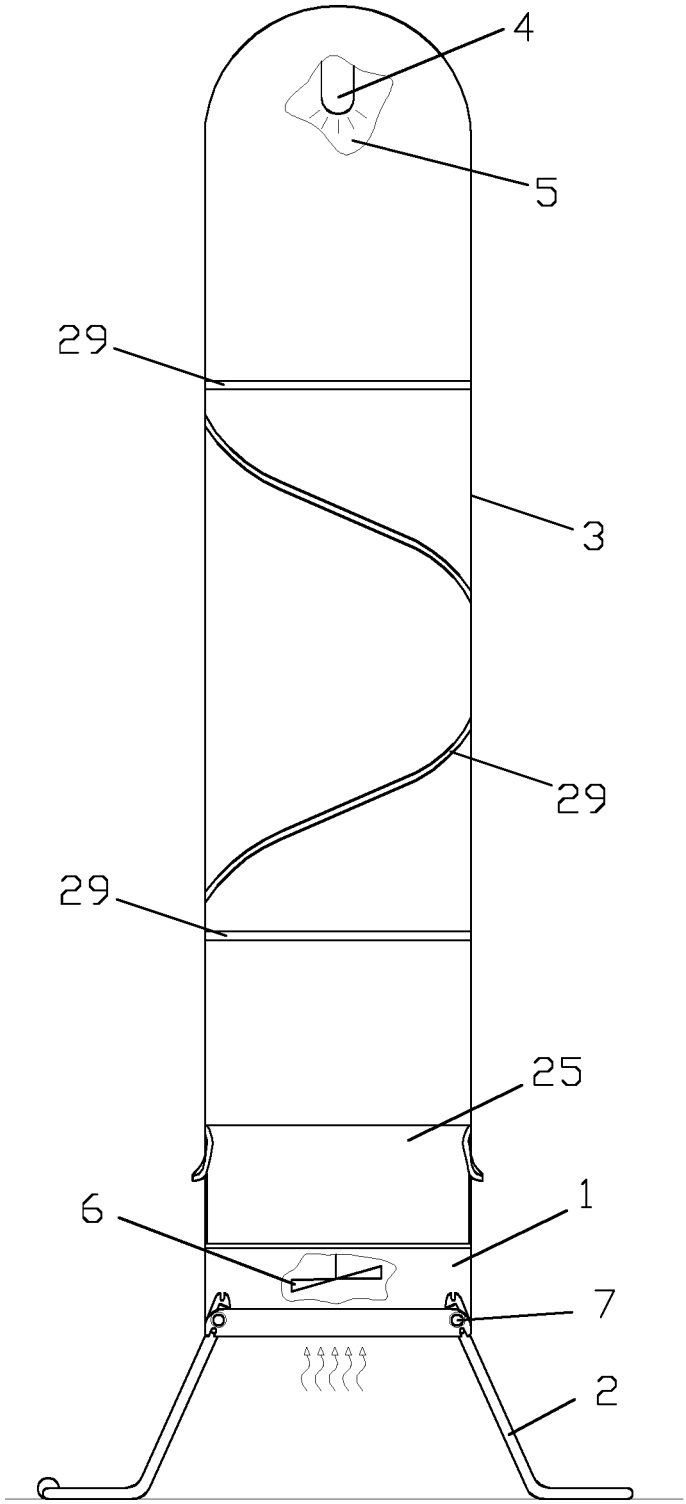
FIG. 1 shows the lighting installation in the operative position, according to an embodiment of the present invention.

While the invention may be susceptible to embodiment in different forms, there are shown in the drawings, and will be described in detail herein, specific embodiments of the present invention, with the understanding that the present disclosure is to be considered an exemplification of the principles of the invention, and is not intended to limit the invention to that as illustrated and described herein.

The inventive lighting installation (FIG. 1) comprises: a base 1 with supports 2; an inflatable shell 3 secured to the base 1, the shell 3 has an inner cavity 5; and an electric lamp 4 located inside the shell 3; wherein the lamp 4 is connected to a power supply (not shown), and wherein the inner cavity 5 (FIG. 1) is in communication with an air blower 6 installed in the base 1. The air blower 6 is in communication with atmosphere via an opening (not shown) provided in the base 1. The air blower 6 can be represented by a fan; the fan is typically connected to a rotation drive (not shown).

Figure 5:
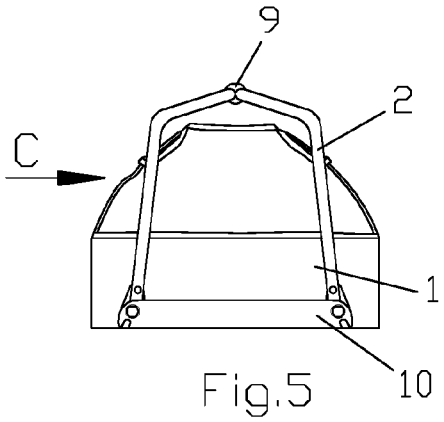
FIG. 5 shows the lighting installation in a folded transportation position, according to an embodiment of the present invention.
Figure 6:
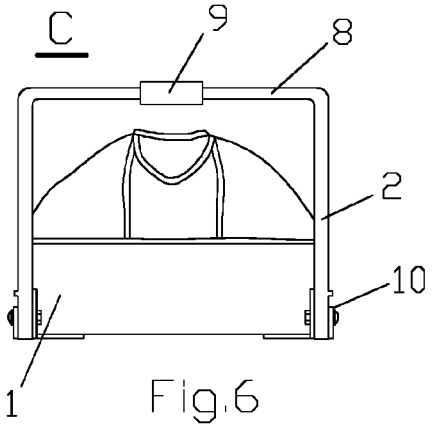
FIG. 6 shows view C of FIG. 5.

Each support 2 has a hinge 7 so configured that provides for turning the support 2 over the base 1 in a front plane and to fix it in the lower operative position (FIGS. 1 to 4) and in the upper transportation position (FIGS. 5, 6).

In an embodiment, each aforesaid support 2 is implemented as a hollow rod (FIGS. 2 to 6) having end portions and a bent part 8. The hinge 7 is located in each aforesaid end portion.

Figure 3:
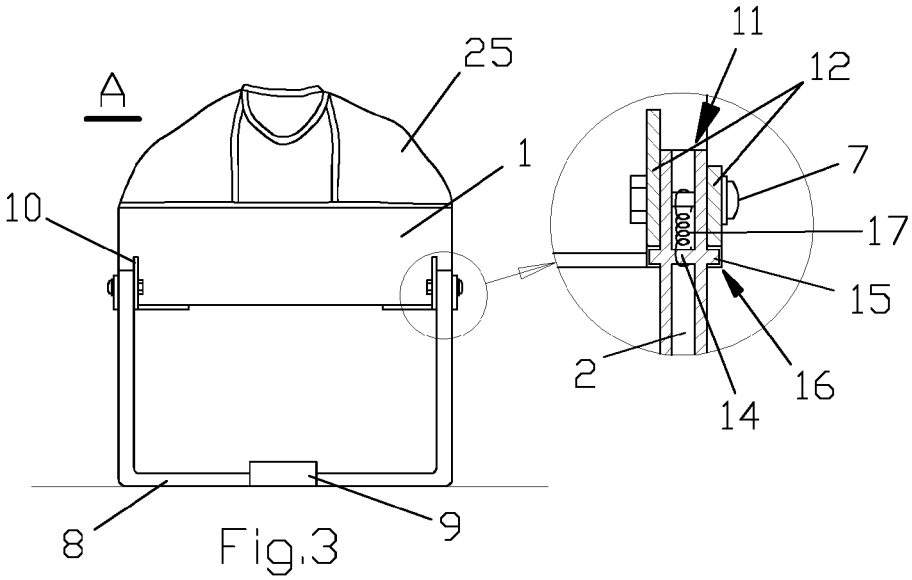
FIG. 3 shows view A of FIG. 2.
Figure 4:
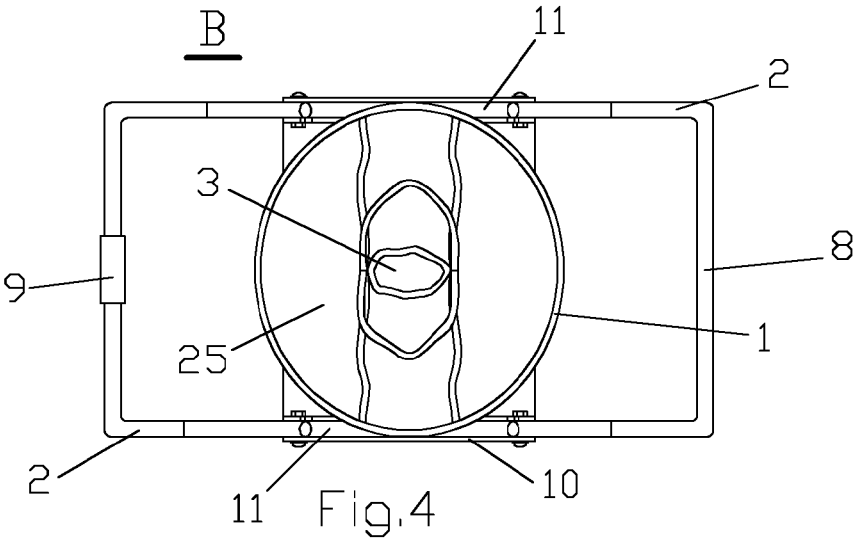
FIG. 4 shows view B of FIG. 2.

When the installation is in the transportation position, the bent parts 8 are met (FIGS. 5, 6) and bound by a handle (herein also called 'brace') 9 for carrying the lighting installation. In the lower operative position, the bent parts 8 are positioned below the base 1 (FIG. 3). The handle 9 is made of a flexible and elastic material and, due to its elasticity; the handle 9 connects the bent parts 8, when in the transportation position.

The articulated (hinged) connection between each support 2 and the base 1 is implemented by a bracket 10 secured to the base 1 (FIGS. 2 to 4), the bracket has ears 11 arranged at the ends thereof. Each ear 11 has cheeks 12 placed opposite to each other (the magnified part in FIG. 3) and the end of the support 2 is arranged in each ear 11 between the cheeks 12, whereas the end is connected to the bracket 10 by means of the hinge 7.

The hinge 7 may be implemented as a round-section cylinder member such as a bolt, a pin, or a shaft, having means for fixing the cylinder member in the openings of the bracket 10.

In one embodiment, the hinge 7, e.g. the aforesaid cylinder member, is freely disposed in a slot 13 (FIG. 13) provided in the support 2, wherein a bar 14 is arranged inside the inner cavity of each support 2; the bar 14 has outer protrusions 15 engaging recesses 16 (FIG. 14) provided at each end of the bracket 10.

The bar 14 is connected to the hinge 7 by means of a spring 17 placed inside the cavity of each supports 2. A few recesses are provided at each end of the bracket 10, wherein the recesses correspond to positions of the support 2. The protrusions 15 of the support 2 serve as clamps enabling the support 2 to be fixed in a predetermined upper position and in a predetermined lower position.

Figure 7:
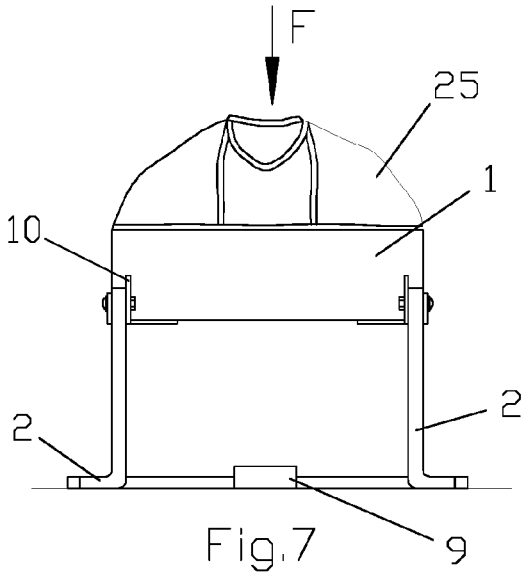
FIG. 7 shows the lighting installation before coming into the operative position; the lighting installation is positioned on the supports bent in two planes (the supports are shown in the lowermost operative position), according to an embodiment of the present invention.
Figure 8:
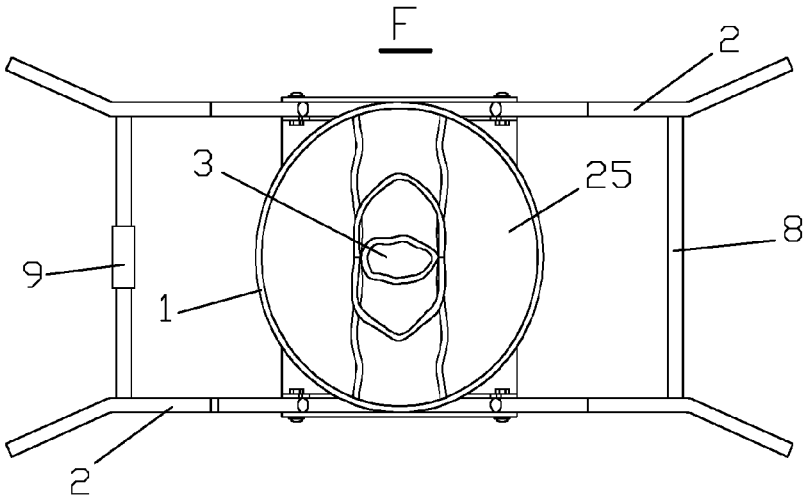
FIG. 8 shows view F of FIG. 7.
Figure 9:
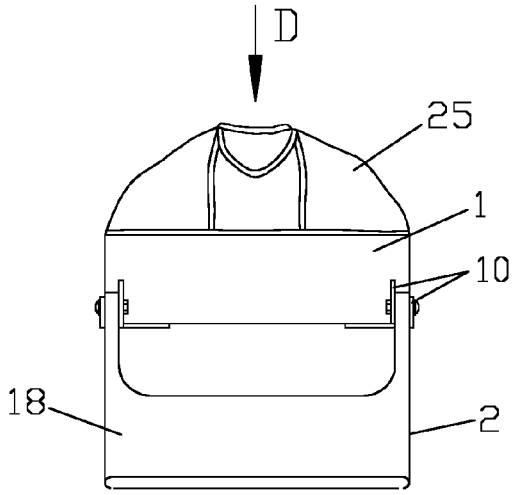
FIG. 9 shows the lighting installation before coming into the operative position, the lighting installation positioned on the supports having solid guard walls (the supports are shown in the lowermost operative position), according to an embodiment of the present invention.

Each support 2 is bent in a front plane as shown in FIG. 1. In an embodiment, the supports 2 are bent in two planes, i.e. a longitudinal (front) plane and a transversal plane, as shown in FIGS. 7 and 8, thus enabling the load bearing footprint of the lighting installation to be increased thereby improving its stability.

Figure 10:
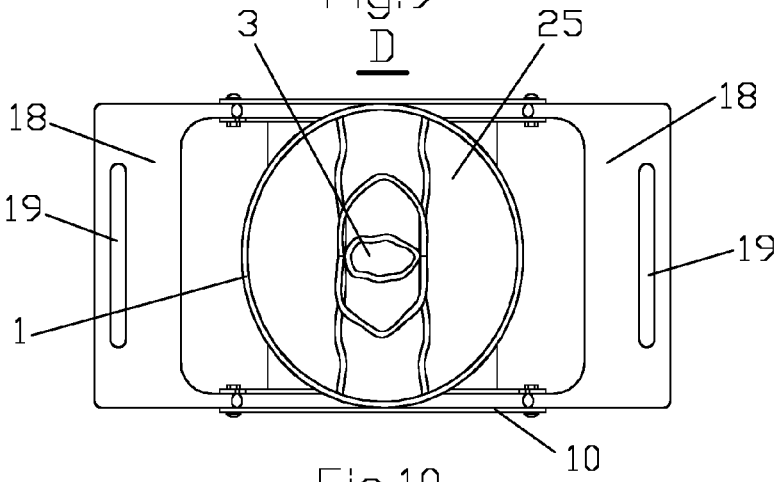
FIG. 10 shows view D of FIG. 9.

In another embodiment of the lighting installation each support 2 (FIGS. 9 to 12) is made molded of a plastic material or blanked of a sheet material. A substantial feature of such a support is that the support 2 has a solid guard wall 18 configured to shield the inflatable shell from a side, when the shell is in a folded transportation position. In this embodiment, each support 2 has a cutout 19 (FIGS. 10, 11) for a hand to carry the installation being in the folded transportation position.

Figure 15:
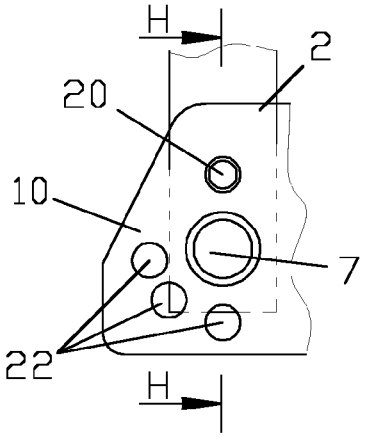
FIG. 15 shows a second embodiment of the articulated connection between the support and the base, and fixing the support, according to an embodiment of the present invention.
Figure 16:
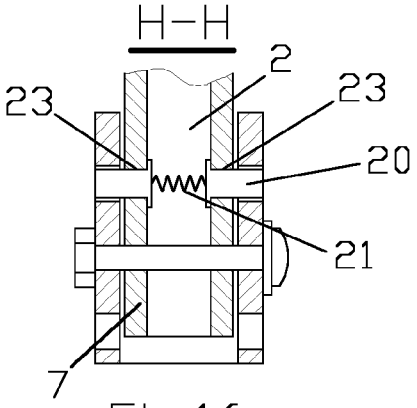
FIG. 16 shows cross-section H-H of FIG. 15.

The support 2 can also be fixed on the bracket 10 by means of clamps 20 which are spring-loaded by springs 21 (FIGS. 15, 16). The clamps 20 engage openings 22 provided in the bracket 10. The clamps 20 are movably installed in openings 23 of the support 2. The openings 22 are arranged as to be aligned with the openings 23 when the support 2 is turned from its uppermost position to the lower operative positions.

Figure 17:
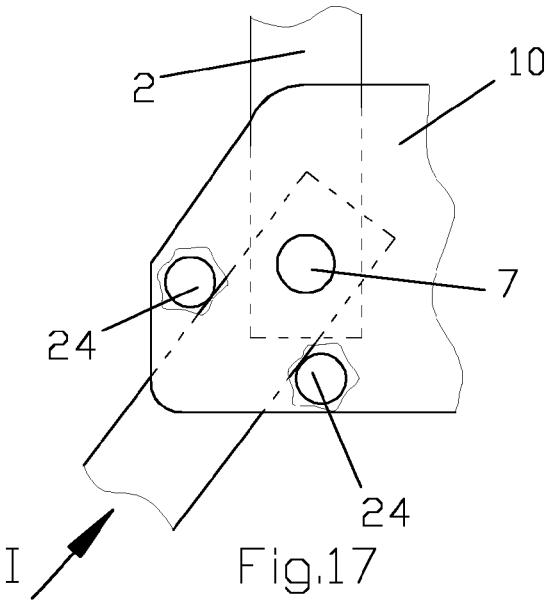
FIG. 17 shows a third embodiment of the connection between the support and the base, and fixing the support, according to an embodiment of the present invention.
Figure 18:
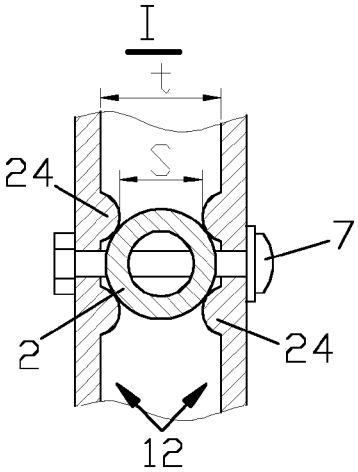
FIG. 18 shows view I of FIG. 17.

Besides, each support 2 can also be fixed on the bracket 10 by means of a plurality of bosses 24 provided on the cheeks 12 of the ear 11 of the bracket 10, the bosses 24 are arranged circumferentially with the center of a circumference coincided with the shaft of the hinge 7 (only two pairs of the bosses 24 are shown in FIGS. 17 and 18). The pairs of the bosses 24 are facing each other and the support 2 can be forced to pass between them when the support 2 is turned from its uppermost position to the lower operative positions and vice versa. In this case, the ear 11 is configured to allow its cheeks 12 to be parted aside when the support 2 passes between the cheeks 12 and the support 2 interacts with the bosses 24. This is why the distance s between the bosses 24 is less than a thickness t of the end portion of the support 2 (FIG. 18).

Figure 11:
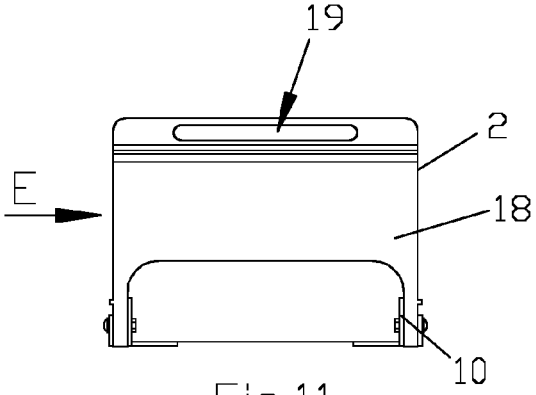
FIG. 11 shows the lighting installation in the transportation position with the supports having solid guard walls (the supports are shown in the uppermost transportation position), according to an embodiment of the present invention.
Figure 12:
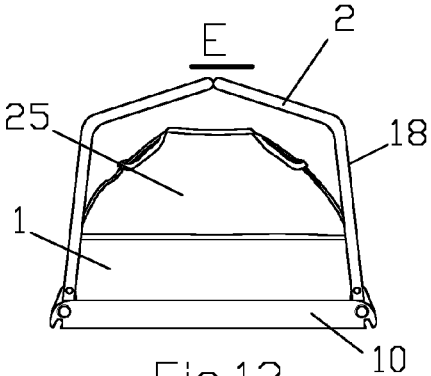
FIG. 12 shows view E of FIG. 11.

The supports 2 are arranged in such a way that the supports are bent at least in one plane and serve inter alia as guard members, which, in one case (FIGS. 5, 6), may be represented by portions of the rod of the support 2, and, in another case (FIGS. 11, 12), the guard member of each support 2 may be represented by the solid wall 18, when the supports 2 are made by molding or blanking; wherein when the lighting installation is in the folded transportation position, its folded inflatable shell 3 with the electric lamp 4 is positioned inside a protective jacket 25 which in turn is positioned between the aforesaid guard members (i.e. portions of the rod of the support 2) or between the walls 18 of the supports 2 as shown in FIGS. 11, 12.

Figure 19:
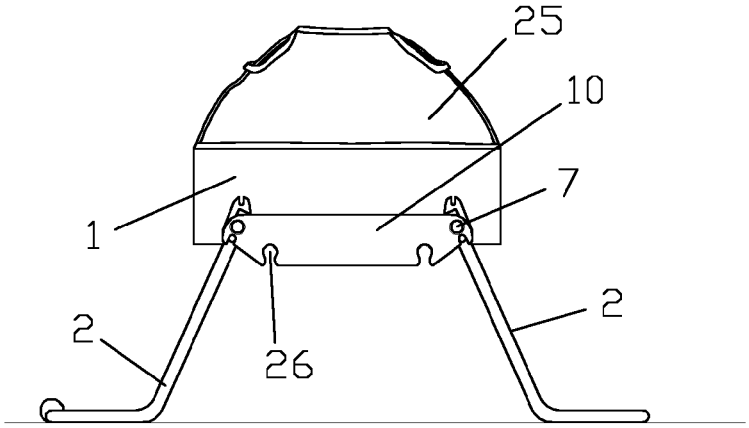
FIG. 19 shows an embodiment of the lighting installation having means for connecting to the power unit, according to an embodiment of the present invention.

Each support 2 is connected to the base 1 by means of the bracket 10 which is rigidly fastened to the base 1, therefore it is provided that the brackets 10 can be installed on the power unit which feeds the lighting installation with electric current. In order to do that each bracket 10 has means for connecting the lighting installation to the power unit, e.g. to a current generator, which is electrically connected to the lighting installation during operation, while the aforesaid means are located on the bottom side of the bracket 10 (FIG. 19).

Figure 20:
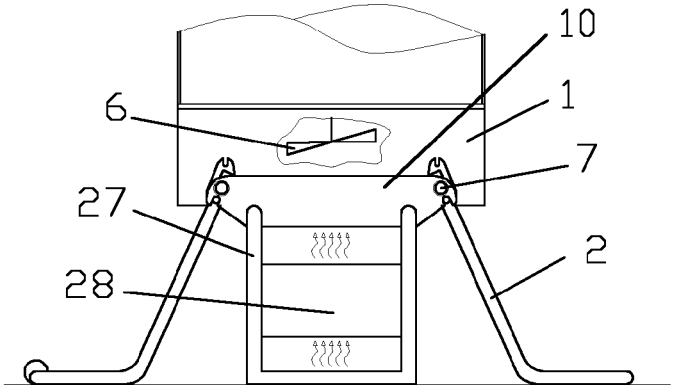
FIG. 20 shows the lighting installation connected to the power unit, according to an embodiment of the present invention.

The means for connecting the lighting installation to the power unit are configured e.g. as sockets 26 (FIG. 19) located between the hinges 7 which link the supports 2 to the base 1, wherein each socket 26 is configured to engage a load-bearing member 27 of a power unit 28 (FIG. 20).

The lighting installation can be equipped with means 29 for adjusting and changing its height. The means 29 are configured as quick-operated releasable fasteners like zip fasteners.

The inventive lighting installation operates as follows. During transporting the installation, it is in a position shown in FIGS. 5, 6 or FIGS. 11, 12. This position protects the lighting installation (particularly its shell and electric lamp) from mechanical impact and damage, wherein the folded supports 2 are bound by the handle 9 (FIGS. 5, 6) or are met when the installation is in the transportation position (FIGS. 11, 12) in such a way that the cutouts 19 of the supports are positioned side by side and form a handle. The handles provide convenient loading, unloading and carrying the lighting installation.

At the site of use of the lighting installation, the supports 2 are parted aside and set into the operative position. If the handle 9 is used for bounding the supports 2, parts of the handle 9 are bent aside beforehand and the supports 2 are released from the handle 9.

Figure 2:
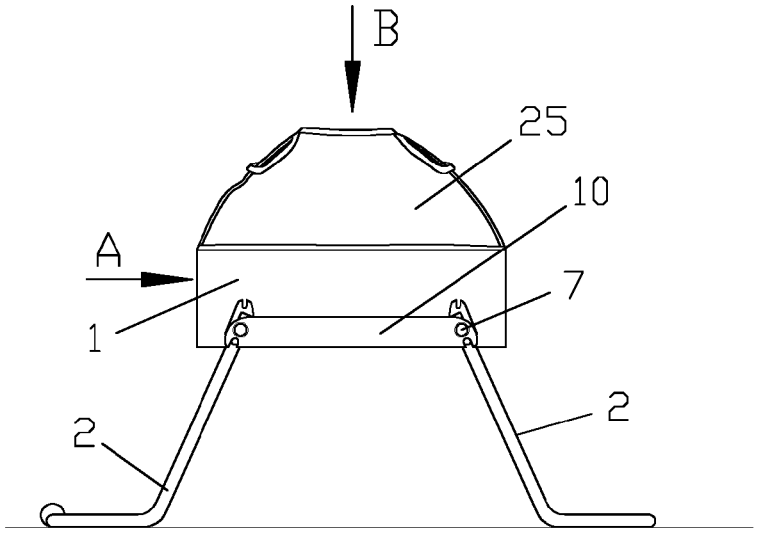
FIG. 2 shows the lighting installation before coming into the operative position, according to an embodiment of the present invention.

The supports 2 are installed into the operative position in the following way. With the lighting installation placed on the ground, the installation is tilted to one side and one support 2 is turned around the hinges 7, then the installation is tilted to the opposite side and the other support 2 is turned around the hinges 7. The parted aside supports 2 are installed on the ground as shown in FIGS. 2 and 3.

Figure 13:
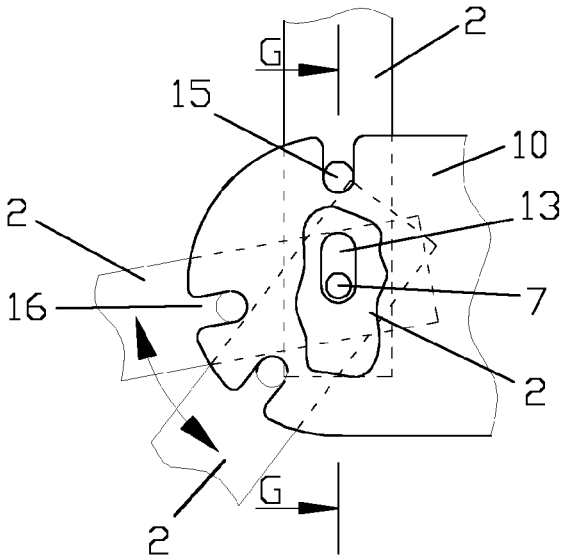
FIG. 13 shows a first embodiment of the articulated connection between the support and the base, implemented by means of the bracket, and fixing the support (the support is shown in three positions thereof), according to an embodiment of the present invention.
Figure 14:
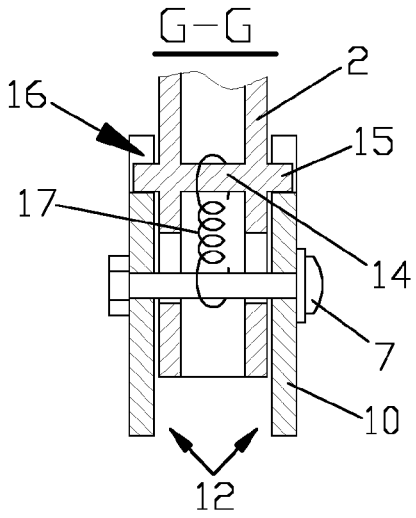
FIG. 14 shows cross-section G-G of FIG. 13.

The projection length of the supports 2 and slope angles thereof are selected and the supports 2 are fixed on the bracket 10 by means of protrusions 15 engaging the recesses 16 corresponding to the slope angles of the supports 2 (FIGS. 13, 14). Each support 2 takes its operative position (FIGS. 2, 3) and is held in the position due to tension of the spring 17 which pulls up the support 2 to the hinge 7 through the bar 14.

Alternatively, the supports 2 are fixed on the bracket by means of clamps 20 which are brought into the openings 22 of the brackets 10 (FIGS. 15, 16).

Still alternatively, the supports 2 are fixed on the brackets 10 by means of the bosses 24 provided on the cheeks 12 of the ears of the bracket 10 (FIGS. 17, 18). In order to do that, the supports 2 are forced to turn around the hinges 7 so as to pass them between the bosses 24 in one direction and prevent the supports 2 from turning in the reverse direction.

After releasing the shell 3 from the protective jacket 25, the drive of the air blower 6 (FIG. 1) is activated and air is charged into the cavity 5 of the shell by means of the blower. Thus, the shell 3 is inflated with air and the upper part of the shell along with the electric lamp 4 rises up and the shell 3 takes its operative position as shown in FIG. 1. The electric lamp 4 is switched on and the surrounding territory is illuminated.

The lighting installation is folded via the backward sequence of actions. To fold the installation, the parts of the rods, used as the supports in one embodiment, or the guard walls 18 of the supports in another embodiment, are closed and the supports 2 form a protective contour around the shell and the electric lamp disposed therein, wherein the contour reduces a probability of damaging the shell and the electric lamp during loading, unloading and transporting the lighting installation.

During the installation's operation, the supports 2 receive the weight load of the installation, wherein, the supports being parted aside, and end the portions of the supports, being bent aside, increase the projection length of abutment points of the supports relative to the vertical axis of the installation, thus increasing stability of the installation.

The projection length of the supports 2 is adjusted by means of recesses 16 (FIG. 13) in which the protrusions 15 of the supports 2 are set selectively (FIG. 14), or by means of the openings 22 of the brackets 10 (FIG. 15) in which the clamps 20 of the supports 2 are set selectively (FIG. 16). Adjusting the projection length of the supports 2 by changing the slope angle thereof is also provided by means of bosses 24 (FIGS. 17, 18) between which the supports 2 are set in such a way that when the supports are in the operative position, the supports abut on the bosses 24 and are fixed in this position corresponding to the operative position of the installation, or the transportation position of the installation.

It should be noted that a plurality of bosses 24 can be provided on the cheeks 12 of the ear 11 of the bracket 10, wherein the bosses 24 allow for the supports 2 to be fixed in a predetermined position with a predetermined slope angle thereof. FIGS. 17 and 18 show only two pairs of the bosses 24.

In order to enable the lighting installation working in narrow places under emergency conditions, and to enable compact deployment of the lighting installation and other installations like the power unit, an inventive method for using the lighting installation is provided, which method is characterized by the following sequence of actions.

Before the lighting installation is deployed from the transportation position into the operative position, the lighting installation is installed on the power unit 28, the brackets 10 are fixed on the load-bearing members 27 of the power unit 28 by entering the members 27 into the sockets 26 of the brackets 10 (FIGS. 19, 20). The load-bearing members 27 are forced and locked in the sockets 26 of the brackets 10. The lighting installation is electrically connected to the power unit 28. Air is charged into the inflatable shell by means of the air blower 6 (FIG. 1).

The power unit 28 is placed on the ground between the supports 2 of the lighting installation. The slope angle of the supports 2 and the projection length thereof are adjusted in such a way that the weight load of the lighting installation is evenly distributed over the supports 2 and the power unit 28. During operation, the lighting installation is used being in a secured position upon the power unit 28. Besides, the specified advantageous effect, all of the above improve stability of the lighting installation in use, which is a substantial factor when the lighting installation is used under extremely emergency conditions related to rescue operations.

Further, this method for using the lighting installation facilitates cooling the power unit and improves reliability of its operation as the air flow captured by the air blower 6 from the atmosphere passes through the area where the power unit 28 is located (FIG. 20). This is specifically beneficial when the lighting installations and the power units are used under hot climate conditions and under conditions of technogenic disasters in areas of thermal risks for machinery.

The invention claimed is:

1. A lighting installation comprising:

a base;

an air blower mounted in the base;

an inflatable shell secured to the base; said shell includes an inner cavity being in communication with said air blower;

at least one electric lamp positioned inside the shell; and a plurality of supports mounted on the base; each said support has a bent part, at least one end portion, and at least one hinge mounted to the corresponding end portion and providing for turning the support above the base into an upper transportation position, or turning the support below the base into a lower operative position; and wherein:

when the supports are situated in the upper transportation position, the bent parts of said supports are met, thereby forming a handle suitable for carrying said lighting installation.

2. The lighting installation according to claim 1, wherein each said support further includes a slot; and the base is connected to each said support via a bracket rigidly secured to the base;

said bracket includes a number of openings; said bracket is hingedly connected to said end portions of the supports thereby forming said hinge provided by a cylinder member having end parts, said cylinder member is positioned within said slot, and said end parts are arranged in said openings of the bracket.

3. The lighting installation according to claim 2, wherein:

each said support is configured as a rod, wherein a part of the rod is bent in a longitudinal plane and in a transversal plane or in a longitudinal plane only, thereby forming said bent part for each said rod, and, when the lighting installation is situated in the upper transportation position, the bent parts of the rods are met above the base and bound by a jacket to facilitate carrying the lighting installation; and when the lighting installation is situated in the lower operative positions, the bent parts of the rods are positioned below the base.

4. The lighting installation according to claim 2, wherein each said support is configured as a rod having free ends; the free ends are bent outwardly from the base, when the lighting installation is in the lower operative position, thereby forming a bent area of said support;

wherein: when the lighting installation is situated in the lower operative position, a brace is provided between the free ends of each said support; wherein the brace is located in the bent area of the supports.

5. The lighting installation according to claim 2, wherein said end portions of the supports include cavities inside thereof;

each said bracket includes recesses arranged at the ends thereof;

each said support further includes a means for fixing the support in the lower operative position and in the upper transportation position; wherein the means for fixing the supports are configured as bars located inside the cavities, the bars include outside protrusions; said recesses are configured for engaging the protrusions; and wherein the bars are connected to said at least one hinge by a spring located inside the cavity of the end portion of each said support.

6. The lighting installation according to claim 2, wherein a plurality of openings are arranged in the end portions of each said support and at the ends of each said bracket, and wherein the means for fixing the supports are configured as spring-loaded members located in said openings.

7. The lighting installation according to claim 2, wherein a plurality of ears are provided at the ends of each said bracket; the ears each includes cheeks placed opposite to each other; and said means for fixing the supports are configured as a plurality of bosses; wherein each said boss is provided on each of the cheeks of each said ear of the bracket; each pair of said bosses is characterized by a predetermined distance therebetween; said end portions of the supports each is characterized with a predetermined thickness;

wherein the distance between the bosses is less than said thickness of the end portions of the supports to enable passing the support under pressure between the bosses; the end portions located in the ears, and the ears are configured to allow the cheeks thereof to be displaced aside when the support interacts with the bosses.

8. The lighting installation according to claim 2, wherein each said bracket has a bottom side; said bracket has means for connecting the lighting installation to a power supply unit; said power supply unit is electrically connected to the lighting installation during operation; and said means for connecting are located on the bottom side of the bracket.

9. The lighting installation according to claim 8, wherein said supply unit includes frame members, said means for connecting are configured as sockets engaging said frame members.

10. A method of using the lighting installation according to claim 1; wherein said lighting installation is characterized with a weight load; said supports, being mounted, are characterized with a slope angle and a projection length thereof; and wherein said method comprising the steps of:

providing a power supply unit set on the ground;

installing and securing the lighting installation on the power supply unit between the supports of the lighting installation;

transforming the lighting installation from the upper transportation position into the lower operative position before deployment thereof;

adjusting the slope angle of the supports and the projection length thereof in such a way that the weight load of the lighting installation is evenly distributed over the supports and the power supply unit;

electrically connecting the lighting installation to the power supply unit;

inflating the inflatable shell with air by means of the air blower; and using the lighting installation for illumination.

* * * * *